US010087598B1

(12) United States Patent
Babcock

(10) Patent No.: US 10,087,598 B1
(45) Date of Patent: Oct. 2, 2018

(54) COUNTERFORT RETAINING WALL

(71) Applicant: John Babcock, Eden, UT (US)

(72) Inventor: John Babcock, Eden, UT (US)

(73) Assignee: INSIDE BET LLC UT (US)

( * ) Notice: Subject to any disclaimer, the term of this patent is extended or adjusted under 35 U.S.C. 154(b) by 0 days.

(21) Appl. No.: 15/719,397

(22) Filed: Sep. 28, 2017

(51) Int. Cl.
*E02D 29/02* (2006.01)

(52) U.S. Cl.
CPC ..... *E02D 29/0266* (2013.01); *E02D 29/025* (2013.01); *E02D 29/0233* (2013.01); *E02D 2300/002* (2013.01); *E02D 2600/20* (2013.01); *E02D 2600/30* (2013.01)

(58) Field of Classification Search
CPC combination set(s) only.
See application file for complete search history.

(56) References Cited

U.S. PATENT DOCUMENTS 4,572,711 A * 2/1986 Benson ..... E02D 29/0266 405/273
7,001,110 B2 * 2/2006 Lockwood ..... E01F 5/005 405/284

* cited by examiner

*Primary Examiner* — Kyle Armstrong
(74) *Attorney, Agent, or Firm* — Kunzler, PC.

(57) ABSTRACT

A counterfort retaining wall system includes a plurality of wall panels and a face joint member positioned between a first wall panel and a second wall panel. The face joint member is partially positioned on a first side of the wall panels and extending between the wall panels through to a second side of the wall panels. The system further includes a counterfort beam coupled at a first end to the face joint member and including a counterfort web and a counterfort flange. The counterfort beam extends away from the wall panels and is configured to extend into a backfill behind the plurality of wall panels. The counterfort beam is coupled to the face joint member such that a bottom surface of the counterfort flange is above a bottom edge of the face joint member.

21 Claims, 18 Drawing Sheets

COUNTERFORT RETAINING WALL

FIELD

This invention relates to retaining walls and more particularly relates to precast concrete structures that retain soil.

BACKGROUND

Typical applications for retaining walls are highway, railroad, and seawall structures. Counterfort walls have been used for numerous highway and railroad embankment support structures. Such structures are used to restrain precast wall panels supported by adjacent, displaced counterforts. The face flanges of the counterforts provide bearing surfaces for the precast wall panels that are supported by and span between adjacent counterforts. As soil and other loads are imposed on the wall structure these subsequent panel loads are transferred to the counterforts which, in turn, subsequently impose these loads to the soil supporting the counterforts. Previous constructions have typically formed a series of tiers of counterfort/panels assemblies wherein subsequent tier levels of precast units were not in contact with either sequentially consecutive upper or lower levels of tiers. A percentage of the imposed loads from the upper tiers are transferred through the compressible soil wall fill. Walls built in this manner would typically have tier heights of three feet to ten feet in height and with total structure heights that could be over sixty-five feet.

SUMMARY

A counterfort retaining wall system is disclosed. The counterfort retaining wall system includes a plurality of wall panels in an array and forming a plurality of tiers, a face joint member positioned between a first wall panel and a second wall panel, the face joint member partially positioned on a first side of the wall panels and extending between the wall panels through to a second side of the wall panels. The system includes a counterfort beam coupled at a first end to the face joint member and comprising a counterfort web and a counterfort flange, wherein the counterfort beam extends away from the wall panels and is configured to extend into a backfill behind the plurality of wall panels, wherein the counterfort beam is coupled to the face joint member such that a bottom surface of the counterfort flange is above a bottom edge of the face joint member. Other embodiments are also disclosed.

In some embodiments, the bottom surface of the counterfort flange is above a location at least one third of a height of the face joint member. In some embodiments, the counterfort beam further comprises an inclined rear panel. In some embodiments, the counterfort beam is coupled to the face joint member such that a bottom surface of the counterfort flange is above a horizontal junction between the tiers. In some embodiments, the wall panels are rectangular panels comprising a panel face, a rear panel face, a top panel edge, a bottom panel edge, a first side panel edge, and a second side panel edge, and wherein the face joint member comprises a web and flange, wherein the web is positioned between the first side panel edge of the first wall panel and the second side panel edge of the second wall panel.

In some embodiments, the web spans an entirety of a length of the counterfort beam and the flange does not span an entirety of the length of the counterfort beam. In some embodiments, at the first end of the counterfort beam, the web extends through the flange. In some embodiments, the flange and the web span an entirety of a length of the counterfort beam. In some embodiments, the counterfort beam is coupled to the face joint member such that the flange at the first end of the counterfort beam extends out and above a compressed backfill. In some embodiments, the counterfort beam further comprises an inclined rear panel, wherein the inclined rear panel is a separate piece coupled to the web and the flange of the counterfort beam.

In some embodiments, the counterfort beam is coupled to the face joint member by a threadbar that extends through the counterfort beam and into the face joint member, wherein the threadbar comprises an inner metal threaded bar and an outer protective sleeve with a grease layer between the inner metal threaded bar and the outer protective sleeve. In some embodiments, a first end of the threadbar is formed within the face joint member. In some embodiments, the system further includes a void replacement member positioned below the counterfort flange of the counterfort beam at the first end of the counterfort beam. In some embodiments, the counterfort web is orthogonal to the counterfort flange and the wall panel, and the counterfort flange is orthogonal to the wall panel.

A counterfort retaining wall system is disclosed. The counterfort retaining wall system includes a plurality of wall panels in an array and forming a plurality of tiers, a face joint member positioned between a first wall panel and a second wall panel, the face joint member partially positioned on a first side of the wall panels and extending between the wall panels through to a second side of the wall panels. The system includes a counterfort beam coupled at a first end to the face joint member and comprising a counterfort web and a counterfort flange, wherein the counterfort beam extends away from the wall panels and is configured to extend into a backfill behind the plurality of wall panels, wherein the counterfort beam further comprises an inclined rear panel at a second end of the counterfort beam. Other embodiments are also disclosed.

In some embodiments, the counterfort beam is coupled to the face joint member such that a bottom surface of the flange is above a bottom edge of the face joint member. In some embodiments, the counterfort beam is coupled to the face joint member through a threadbar that extends through the counterfort beam and the face joint member, wherein the threadbar comprises an inner metal threaded bar and an outer protective sleeve with a grease layer between the inner metal threaded bar and the outer protective sleeve. In some embodiments, the counterfort beam is coupled to the face joint member such that a bottom surface of the counterfort flange is above a horizontal junction between the tiers. In some embodiments, the inclined rear panel is a separate piece coupled to the web and the flange of the counterfort beam.

A counterfort retaining wall system is disclosed. The counterfort retaining wall system includes a plurality of wall panels in an array and forming a plurality of tiers, a face joint member positioned between a first wall panel and a second wall panel, the face joint member partially positioned on a first side of the wall panels and extending between the wall panels through to a second side of the wall panels. The system includes a counterfort beam coupled at a first end to the face joint member and comprising a counterfort web and a counterfort flange, wherein the counterfort beam extends away from the wall panels and is configured to extend into a backfill behind the plurality of wall panels, wherein the counterfort beam is coupled to the face joint member such that a bottom surface of the flange is above a bottom edge of the face joint member, and wherein the counterfort beam further comprises an inclined rear panel at a second end of the counterfort beam. Other embodiments are also disclosed.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Figure 1A:
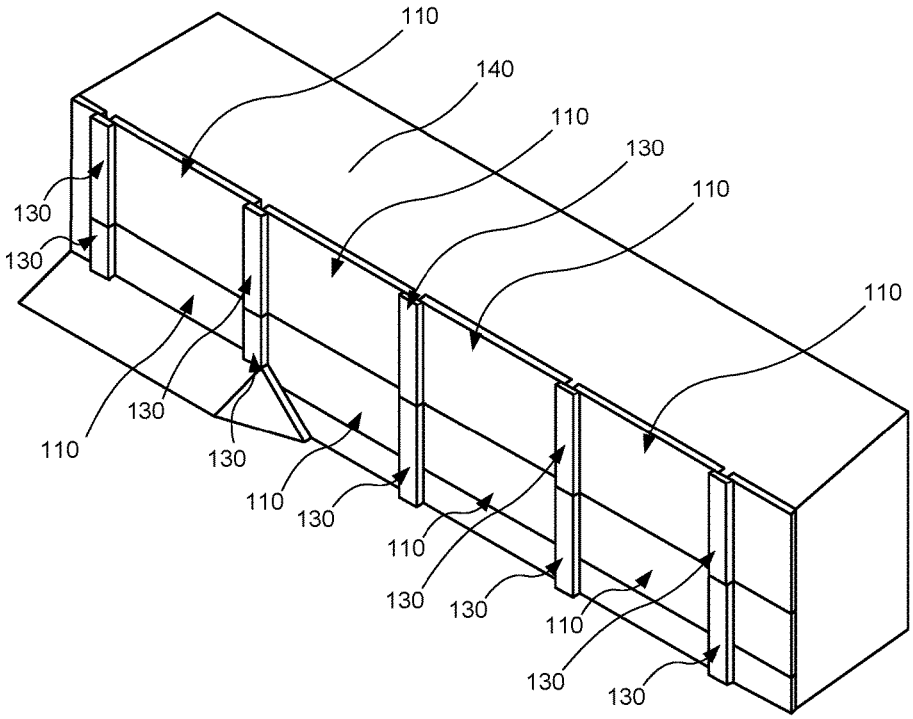
FIG. 1A is a perspective view illustrating one embodiment of a counterfort wall system in accordance with some embodiments of the present invention.

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment, but mean "one or more but not all embodiments" unless expressly specified otherwise. The terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

Furthermore, the described features, structures, or characteristics of the invention may be combined in any suitable manner in one or more embodiments. In the following description, numerous specific details are provided for a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

Various methods have been used to construct precast walls for retaining earth, soil, sand or other fill (generally referred to as soil). Some methods utilize full height panels. That is, the wall panels span the entire height of the retaining wall. Such full height panels have disadvantages. Temporary erection braces are required for these systems to hold the panels in place when the backfill (soil) is placed behind the wall. This requires additional working right-of-way in front of the wall and restricts site access.

For this and other reasons, smaller panels are utilized in many cases for retaining walls. In some instances, the wall panels are not placed directly above or below adjacent wall panels. Such a retaining wall is built with offset tiers, where an upper tier is set back from a lower tier to reduce the load present on the lower tier.

In some instances, counterfort members are utilized which extend back into the backfill to transfer loads back into the backfill soil. However, such counterfort members are placed at the horizontal joint elevations between the wall panels. Although the material costs for these types of wall systems are low, high labor costs for the various stages of wall construction can result in installed price of walls that are substantially higher than the material costs. One reason is because to place the counterfort members requires slot cuts into the backfill. With the counterfort members being placed at the horizontal joint elevations between the wall panels, a deeper slot cut is necessary.

In addition, counterfort members of such systems have large profiles and utilize L-shaped counterfort members. Embodiments of the invention utilize T-shaped counterfort members which are elevated above the horizontal joint elevations. The use of these elevated base T-shaped counterforts results in a minimal imposed retained soil loading on the foundation material. Due the profile of the elevated base T-shaped counterforts the effective imposed tier soil loads can approach the unit weight of soil times the height of the soil. In contrast, the use of the previously used L-shaped counterforts of comparable height, will impose higher loads on the foundation soils at the base of the wall and between subsequent wall tiers. To address this effect, so that the soil bearing capacity is not exceeded, with the L-shaped counterforts either a much wider base section or other additional foundation enhancement means would be required to consider the L-shaped counterforts of comparable height.

Embodiments of the invention allow for reduction in labor costs in conjunction with low material costs. Some embodiments allow for shallower slot cuts into backfill, while maintaining the structural soundness of the retaining wall. Some embodiments allow for an upper tier of wall panels to be placed directly above a lower tier of wall panels without excessive transfer of loads from the upper tier to the lower tier. Some embodiments allow for smaller profile counterfort members than are utilized for Some embodiments of the invention allow for the bottom elevation of the slot cut to be approximately between one-third and one-half higher than the elevation the elevation of the bottom of a slot that would be required for the L-shaped counterfort. As a result of the elevated base T-shaped counterfort profile the excavation is reduced compared to the slot cut depth that would be needed for the L-shaped counterfort. Some embodiments may be less than one-third the elevation of the bottom of a slot that would be required for the L-shaped counterfort. Some embodiments may be greater than one-half the elevation of the bottom of a slot that would be required for the L-shaped counterfort.

FIG. 1A depicts a perspective view illustrating a counterfort wall system 100 in accordance with one embodiment of the present invention. Although the system 100 is shown and described with certain components and functionality, other embodiments of the system 100 may include fewer or more components to implement less or more functionality.

FIG. 1A depicts a plurality of wall panels 110. The wall panels 110 form an array in a two-dimensional plane. In the depicted embodiment, the wall panels 110 are located one above another. That is, as depicted, a first tier of wall panels 110 is shown placed across a base of the wall and a second tier of wall panels 110 are directly above the first tier of wall panels 110 as opposed to set back slightly behind the first tier of wall panels 110.

Located between the wall panels 110 are face joint members 130. The face joint members 130 are coupled to counterfort beams (not visible) which extend back behind the wall. Also depicted is backfill 140 which may include earth, soil, sand, and/or other fill.

Figure 1B:
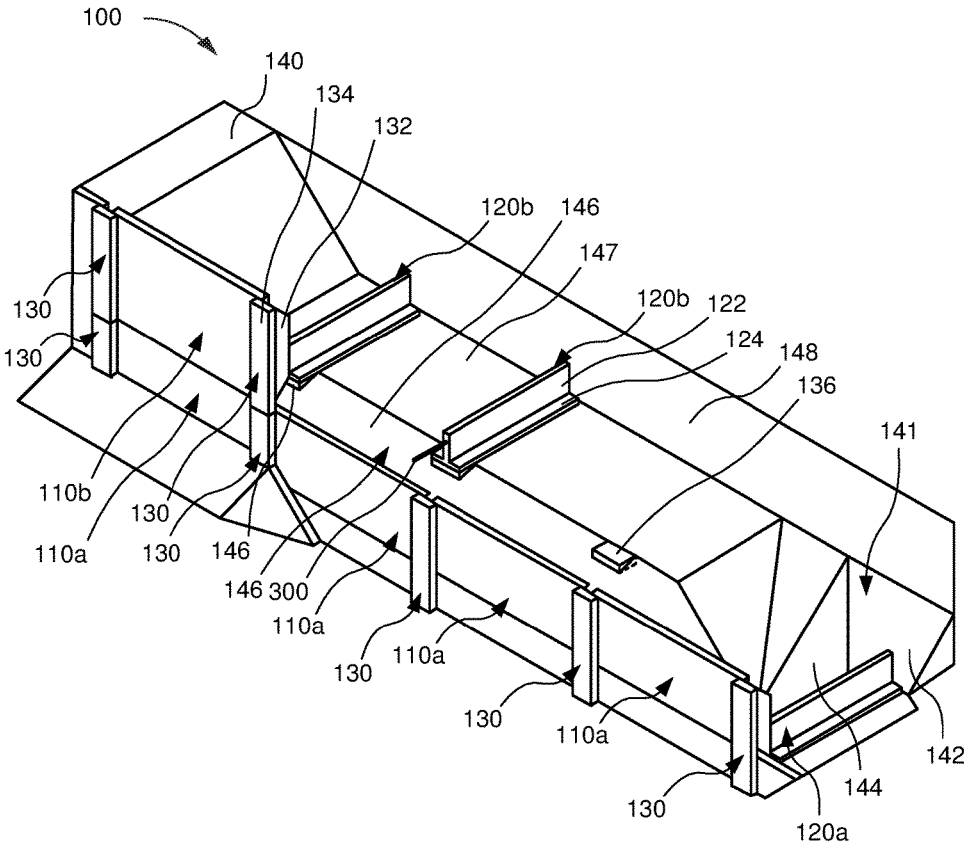
FIG. 1B is a perspective cut-away view illustrating the counterfort wall system of FIG. 1A in accordance with some embodiments of the present invention.

FIG. 1B depicts a perspective cut-away view illustrating the counterfort wall system 100 of FIG. 1A with a portion of the wall panels 110 and other components removed to allow for a proper understanding the various components of the counterfort wall system 100. The wall is depicted as only partially constructed to show the various components that would be buried in backfill behind the wall. Although the system 100 is shown and described with certain components and functionality, other embodiments of the system 100 may include fewer or more components to implement less or more functionality.

FIG. 1B depicts a plurality of wall panels 110 including a first tier or lower tier of wall panels 110*a* which run across a base of the wall. A majority of the second tier of wall panels 110*b* except for a single wall panel 110 shown at the left end of the wall are removed. In the illustrated embodiment, the wall panels 110 are rectangular slabs. In other embodiments, the wall panels may be formed or manufactured into other shapes and configurations.

The wall panels 110 include a panel face which functions as the visible portion of the wall panels 110 upon completion of the wall. The panel face forms a substantially vertical two-dimensional plane. In some embodiments, the panel faces of the upper tier wall panels 110*b* are coplanar with the panel faces of the lower tier wall panels 110*a*. In some embodiments, the panel faces of the upper tier wall panels 110*b* are not coplanar with the panel faces of the lower tier wall panels 110*a* but are offset and parallel to each other.

The wall panels 110 include a rear panel face which is the portion of the wall panels covered by the backfill 140 upon completion of the wall. The rear panel face forms a substantially vertical two-dimensional plane. In some embodiments, the rear panel faces of the upper tier wall panels 110*b* are coplanar with the rear panel faces of the lower tier wall panels 110*a*. In some embodiments, the rear panel faces of the upper tier wall panels 110*b* are not coplanar with the rear panel faces of the lower tier wall panels 110*a* but are offset and parallel to each other.

The wall panels 110 include a top panel edge and a bottom panel edge. As the wall is constructed in tiers starting at the base and working upwards the bottom panel edge of an upper wall panel 110*b* is directly above the top panel edge of a lower wall pane 110*a*. In some embodiments, the bottom panel edge of the upper wall panel 110*b* rests on the top panel edge of a lower wall pane 110*a*. In some embodiments, the bottom panel edge of an upper wall panel 110*b* is directly above but does not contact the top panel edge of a lower wall pane 110*a*. In a fully constructed wall, the top panel edge and the bottom panel edge, in some embodiments, form a substantially horizontal two-dimensional plane. In some embodiments, a horizontal junction occurs between the lower tier and the upper tier.

The wall panels 110 include a first side panel edge, and a second side panel edge. In a fully constructed wall, the first side panel edge and the second side panel edge form, in some embodiments, a substantially vertical two-dimensional plane orthogonal to the panel face as well as the top panel edge. Where two wall panels 110 meet at their side panel edges, the side panel edges form a vertical junction. However, instead of side panel edges being adjacent to a neighboring wall panel, a face joint member 130 is inserted into the vertical junction which separates the side panel edges from each other.

In some embodiments, the wall panels 110 are precast panels. Precast panels allow for the manufacture of the wall panels 110 in a first location which then can be shipped to an assembly location where the wall is built. In some embodiments, the wall panels 110 are precast concrete panels. Concrete typically includes a hardened mixture of stone, gravel, sand, cement, and water.

In the illustrated embodiment, the system 100 includes face joint members 130. The face joint members are placed in a substantially vertical position between adjacent wall panels 110. The face joint members 130 include a joint web 132 which is disposed between the side panel edge of a first wall panel and the side panel edge of a second wall panel at vertical junction. The face joint members 130 further include a joint flange 134 which is visible upon completion of the wall. The joint flanges 134 extend out and support the wall panels 110 as the panel faces rest against the joint flange 134. In some embodiments, the face joint members 130 lean out to provide a planting space (or exposed soil) between tiers.

In the illustrated embodiment, the system 100 includes a plurality of counterfort beams 120 (120*a*, 120*b*) which are each coupled to a face joint member 130 at a first end of the counterfort beam 120. The counterfort beams 120 are configured to extend back into the backfill 140 and are configured to transfer forces exerted on the wall panels back into the backfill 140.

The counterfort beams 120 may be of different shapes and configurations. In some embodiments, the counterfort beams 120 are tee beams and include a counterfort web 122 and a counterfort flange 124. The counterfort web 122 and the counterfort flange 124 are in substantially orthogonal two-dimensional planes in which the counterfort flange 124 is in a horizontal two-dimensional plane and the counterfort web 122 is in a vertical two-dimensional plane. In some embodiments, substantially orthogonal is within five degrees of orthogonal.

The counterfort flange 124 forms the bottom surface of the counterfort beam 120. In some embodiments, the counterfort beam 120 is coupled to the face joint member 130 such that a bottom surface of the counterfort flange 124 is above a bottom edge of the face joint member 130. In some embodiments, the bottom surface of the counterfort flange 124 is above the horizontal junction 170 between a lower tier of wall panels and an upper tier of wall panels.

The process for constructing a wall is described briefly. The wall is constructed tier by tier. At each tier, the backfill 140 behind the wall includes compacted backfill and uncompacted backfill. The amount and slope of the compacted backfill is, in many cases, dictated by code. For example, a 2:1 slope is standard in many jurisdictions. This is shown is FIG. 2, with the compacted backfill 140*a* starting at a base of the wall 110 and extending backwards at a 2:1 slope. The sloped surface 146 is also depicted in FIG. 1B at the second tier. The compacted backfill 140*a* starts at the wall at the bottom of the upper tier or the top of the lower tier and slopes backwards.

Figure 2:
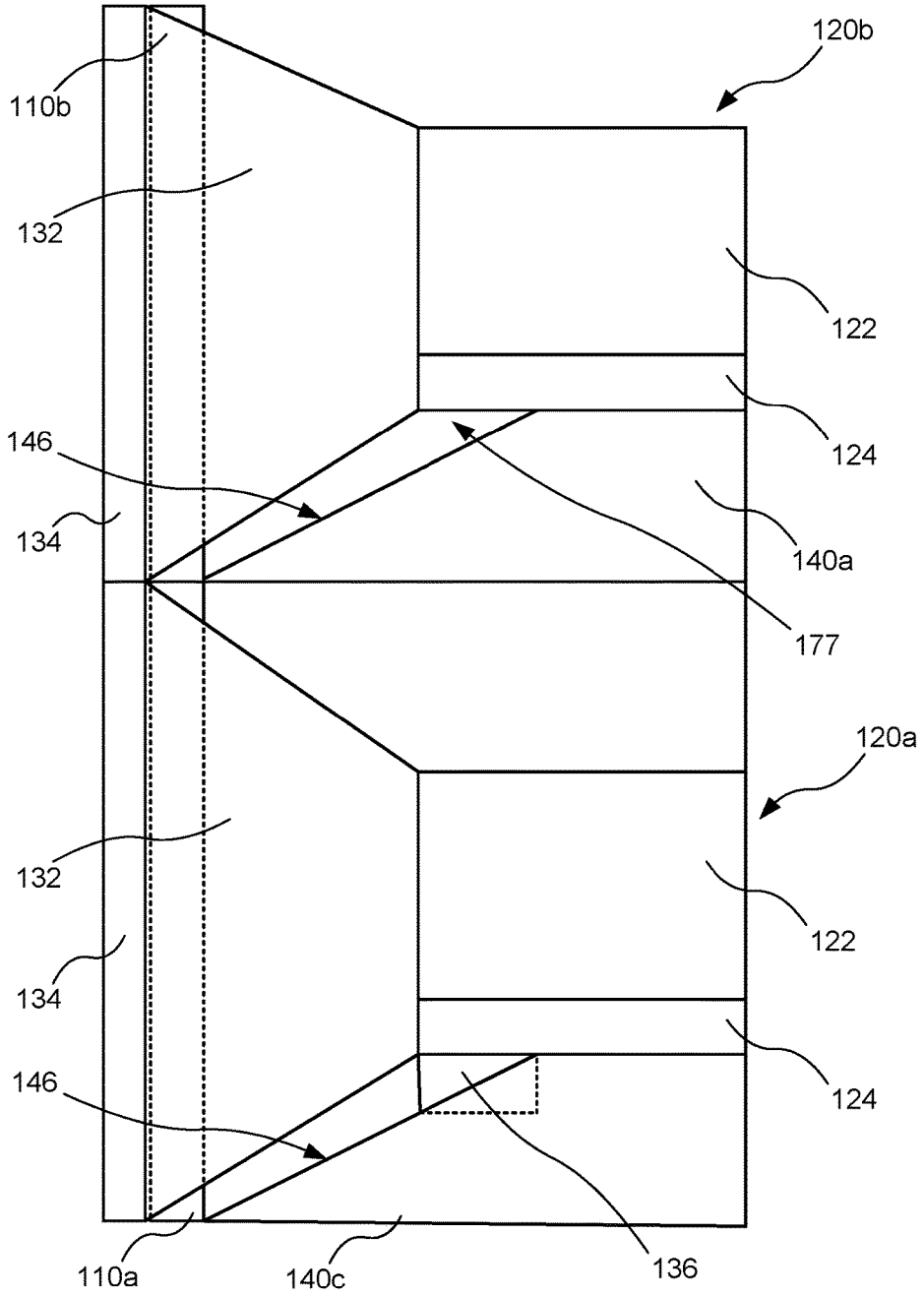
FIG. 2 is a side view illustrating one embodiment of counterfort beams in relation to compacted backfill and wall panels in accordance with some embodiments of the present invention.

To place the counterfort beams 120, it is sometimes necessary to make a slot cut 141 in the backfill 140 or in situ material. A slot cut 141 is done to place the counterfort beam 120 and allow for attachment or coupling of the counterfort beam 120 to a face joint member 130. FIG. 1B depicts a slot cut 141 on the lower tier. The slot cut 141 includes a sloping back cut 142 and sloping side cuts 144. The slot cut 141 must be dug to a depth at least deep enough to place the counterfort beam 120. The bottom surface of the counterfort beam 120 rests on the compacted backfill 140*a* or in situ material 140*c*. Referring to FIG. 2, the lower counterfort beam 120*a* rests on the in situ material 140*c* and the upper counterfort beam 120*b* rests on the compacted backfill 140*a*. A slot cut 141, in some embodiments, is utilized to eliminate the use of shoring on open cuts in the backfill.

Figure 4:
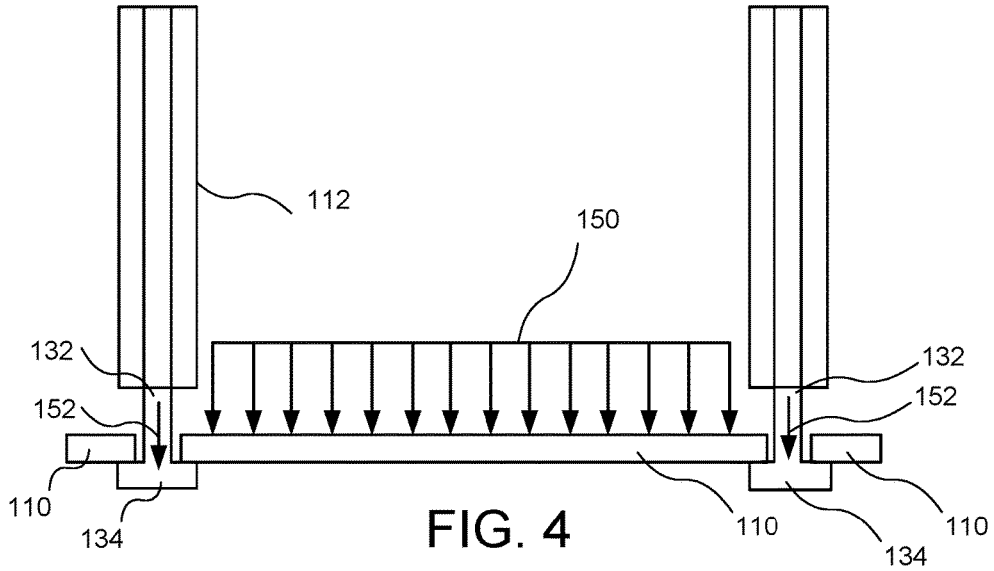
FIG. 4 is a top view illustrating a distribution of loads on the counterfort beams in accordance with some embodiments of the present invention.
Figure 6:
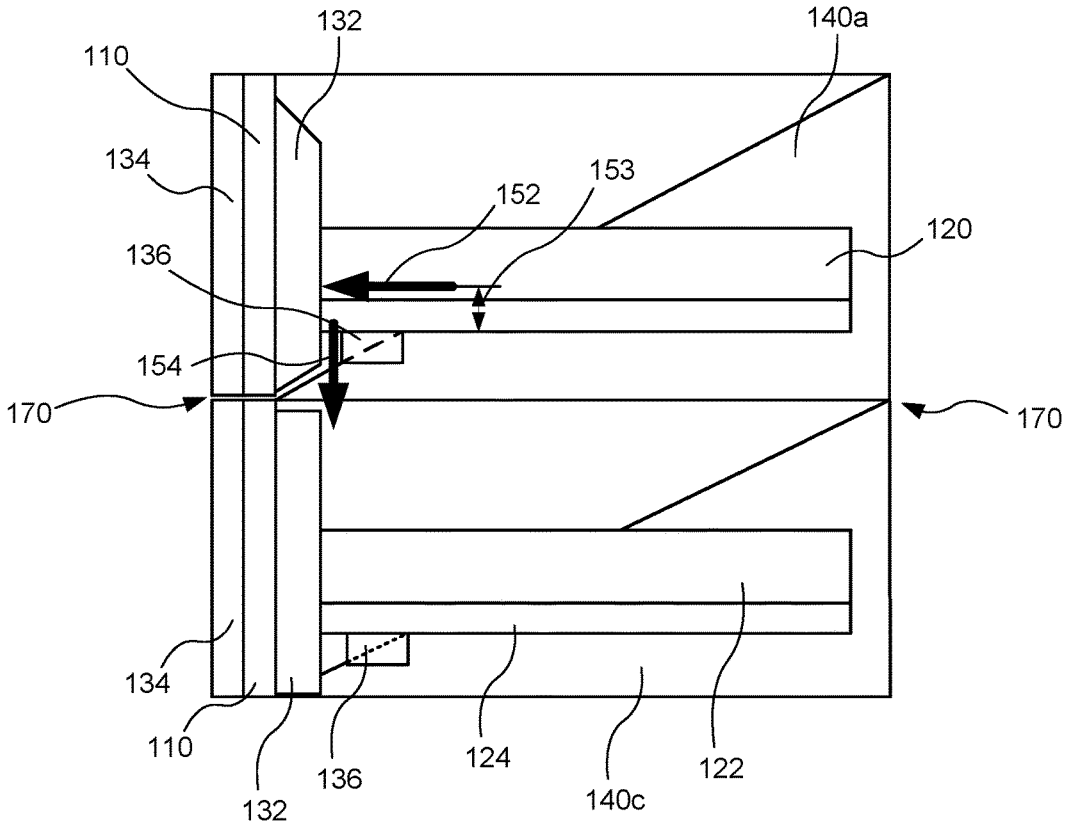
FIG. 6 is a side view illustrating a distribution of tiers of wall panels in accordance with some embodiments of the present invention.

Embodiments described herein allow for the coupling of the counterfort beam 120 at an elevated location such that the bottom surface of the counterfort flange 124 is above a bottom edge of the face joint member or the horizontal junction between tiers. FIG. 4 depicts L-shaped counterfort members 121 in which the bottom surface of the counterfort members 121 is at the same level as the bottom edge of the joint face member 130 or the horizontal junction between tiers. FIGS. 2 and 6 depict the counterfort beams 120 as elevated above the horizontal junction between tiers.

Each face joint member 130 is coupled to a counterfort beam 120*a* on the lower tier. Once coupled, the backfill 140 is replaced within any slot cut 141 and elsewhere and to cover the counterfort beams 120*a*. After finishing the lower tier, the upper tier is constructed and this process is repeated until the wall is constructed tier by tier.

The forces exerted on the wall and transferred back to the soil through the counterfort beams 120 is briefly explained with reference to FIG. 4. FIG. 4 is a top view of wall panels 110, joint face members 130, and counterfort members 120. The soil exerts a generally distributed load (depicted as arrows 150 in FIG. 4) on the rear panel faces of the wall panels 110 which push the wall panels 110 out and against the joint flange 134 of the face joint members 130. The generally distributed load (arrows 150) results in an equivalent resultant load (depicted as arrows 152) on the joint face members 130. The joint face members 130 are coupled to the counterfort beams 120 which extend back into the backfill 140 and the backfill forces and which hold the joint face members 130 in place as the backfill 140 resists displacement of the counterfort beams 120.

Figure 5:
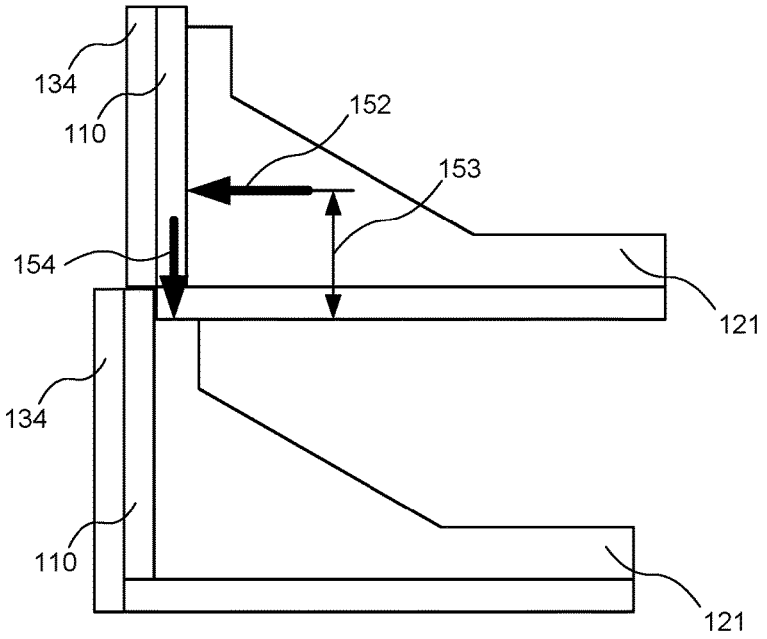
FIG. 5 is a side view illustrating L-shaped counterforts and a distribution of tiers of wall panels.

Referring now to FIG. 5, L-shaped counterfort members 121 are depicted. The L-shaped counterfort members 121 have various drawbacks. First, the larger members result in higher material costs to manufacture and higher shipping costs as well. Second, the L-shaped counterfort members 121 are positioned with the bottom surface of the counterfort members 121 at approximately the bottom surface of the face joint member 130 or the horizontal junction. This results in two main problems: (1) the need to make a deeper slot cut in the backfill to place the counterfort member 121; and (2) larger vertical loads exerted on lower tiers of wall panels. The larger vertical load is explained briefly with reference to FIG. 5.

As discussed above, a resultant load (depicted as arrow 152) is exerted on the joint face members 130. The equivalent resultant load is exerted at a distance above the bottom surface of the counterfort member 121. This distance is depicted by arrow 153. The moment of the resultant load is the distance times the resultant load. The moment exerts a rotational force on the assembly. This rotational force induces a vertical imposed surcharge pressure (depicted as arrow 154) which is exerted on the lower tier. The vertical imposed surcharge pressure may exert larger and larger loads on lower tiers. For this reason, many designs of retaining walls utilize offset wall tiers or are limited on size.

In contrast, referring now to FIG. 6, a counterfort beam 120 is coupled to the face joint member 130 at an elevated position. That is, the bottom surface of the counterfort beam

120 is elevated above the horizontal junction 170 between wall tiers. Put another way, the bottom surface of the counterfort beam 120 is elevated above the bottom surface of the face joint member 130. This helps reduce the depth of a slot cut 141 necessary to place the counterfort beam 120 greatly reducing installation time and labor. In addition to reducing the depth of a slot cut 141 the elevated counterfort beam 120 allows for a reduction in the vertical imposed surcharge pressure.

Similar to what is discussed in conjunction with FIG. 5, a resultant load (depicted as arrow 152) is exerted on the joint face members 130. The equivalent resultant load is exerted at a distance above the bottom surface of the counterfort beam 120. This distance is depicted by arrow 153. The moment of the resultant load is the distance times the resultant load. The moment exerts a rotational force on the assembly. As is seen, the moment arm distance is reduced dramatically which results in a lower magnitude moment. This rotational force induces a vertical imposed surcharge pressure (depicted as arrow 154) which is exerted on the lower tier but the vertical imposed surcharge pressure is greatly reduced and is a function of the height at which the counterfort beam 120 is attached.

As the counterfort beam 120 is coupled at an elevated position, a first end of the counterfort beam 120 extends out and above the compressed backfill 140*a* (or the in situ material 140*c* for the lower counterfort beam). That is, the first end of the counterfort beam 120, at which the counterfort beam 120 is coupled to the face joint member 130, may not be supported by the compacted backfill 140*a* (or in situ material 140*c*) in some cases. A void 177 exists (see FIG. 2). To compensate for the void 177, embodiments of the invention include a void replacement member 136. The void replacement member 136 rests in the compacted backfill 140*a* and extends up to support the counterfort flange 124.

The void replacement member 136 may be made of formed material or confined compacted material that is compacted after placement of the counterfort beam 120. The void replacement member 136, in one embodiment, has adequate bearing capacity as the void replacement member 136 supports the front portion of the counterfort beam 120 while the rear portion is supported by the compacted backfill 140*a* on a horizontal plane 147 formed within a trench.

Figure 3:
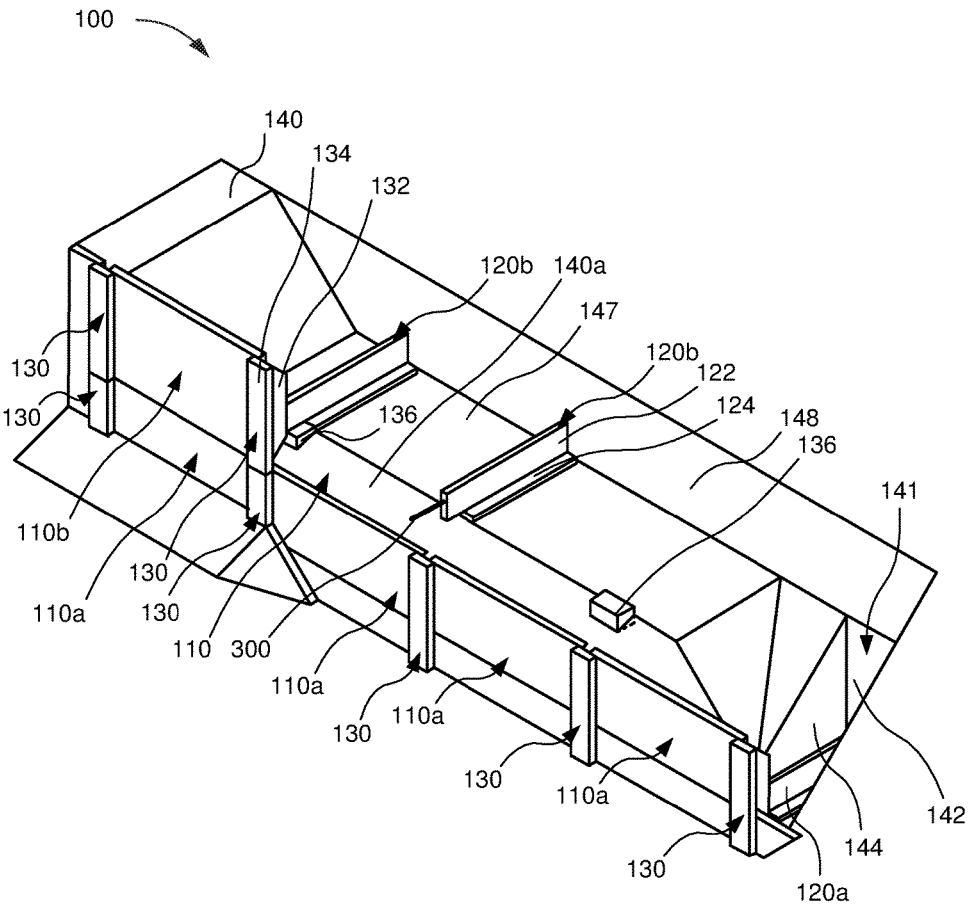
FIG. 3 is a perspective view illustrating another embodiment of a counterfort wall system in accordance with some embodiments of the present invention.

Referring now to FIG. 3, a perspective view illustrating another embodiment of a counterfort wall system 100 is shown. In the illustrated embodiment, the counterfort beams 120*b* are different along with the void replacement member 136. In FIG. 1B, the counterfort flange 124 and the counterfort web 122 span an entirety of a length of the counterfort beam 120. In FIG. 3, the counterfort flange 124 does not span an entirety of the length of the counterfort beam 120. As is shown, the counterfort flange 124 does not extend out to overhang the compressed backfill 140*a*.

In some embodiments, the void replacement member 136 extends higher. In the illustrated embodiment of FIG. 3, the void replacement member 136 supports the counterfort beam 120 at the counterfort web 122 as the counterfort flange 124 does not extend the entirety of the length of the counterfort beam.

As the area of contact between the void replacement member 136 and the bottom of the counterfort web 122 of the counterfort beam 120*b* is minimized as compared to the embodiment depicted in FIG. 1B, there is a minimal degree of field leveling or grade adjustment required between the two members. Since there is a minimal contact/bearing area, in some embodiments, there will be a negligible requirement for grouting at the contact/bearing area. This would typically not be the case for the larger contact/bearing area for the previously shown and described void replacement of FIG. 1B. Such a combination is a viable and potentially cost saving option also since there is a reduced amount of structural concrete.

Figure 7:
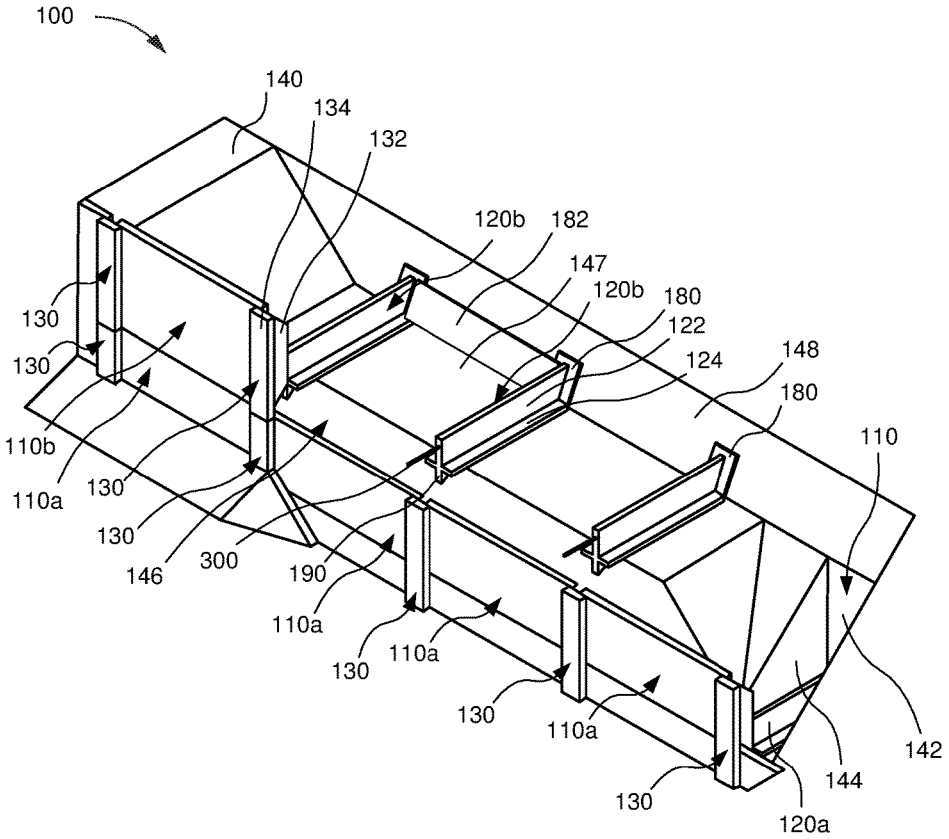
FIG. 7 is a perspective view illustrating another embodiment of a counterfort wall system in accordance with some embodiments of the present invention.

Referring now to FIG. 7 a perspective view illustrating another embodiment of a counterfort wall system 100 is shown. In the illustrated embodiment, the counterfort beams 120*b* includes extended web 190. The extended web 190 is an extension of the counterfort web 122 in which a portion extends through the counterfort flange 124 and out the bottom of the counterfort beam 120.

The extended web 190, in one embodiment, is a triangular shaped web that extends down to contact the slope 146 of the compacted backfill 140*a*. The extended web 190 may eliminate the need for a void replacement member 136, in some embodiments, because the extended web 190 contacts the slope 146 and rests on the compacted backfill 140*a*. After placement of the counterfort beam 120, the backfill 140 under the counterfort flange 124 may be compacted or pushed with tampers or compactors. The extended web 190 acts as a barrier or stop for compacting the backfill under the counterfort flange 124.

In the illustrated embodiment, the counterfort beams 120 further includes inclined rear panels 180. The inclined rear panels 180, in some embodiments, are inclined and extend away from the counterfort flange 124. In some embodiments, the inclined rear panels 180 have the same width as the counterfort flange 124. In some embodiments, the inclined rear panels 180 are narrower than the counterfort flanges 124. In some embodiments, the inclined rear panels 180 are wider than the counterfort flanges 124.

In some embodiments, the inclined rear panels 180 are inclined and match the sloped excavated cut 148 behind the counterfort beam 120*b*. The inclined rear panels 180 will typically be approximately the same orientation as and will be roughly parallel to the angle of the face of the sloped excavation cut 148. In some embodiments, the inclined rear panels 180 are offset from the counterfort flange 124 by an angle of forty-five degrees. In some embodiments, the inclined rear panels 180 extend above the counterfort web 122 as is depicted in FIG. 7.

The inclined rear panels 180 increase the safety factors for pullout because the inclined rear panels 180 provide more surface area. Some embodiments further include an anchor panel 182 which is placed at the second end of the counterfort beam 120 between two counterfort beams 120. The anchor panel 182, in one embodiment, rests on the edges of the inclined rear panels 180. The anchor panel 182, in some embodiments, may be attached to the inclined rear panels 180. The increased surface area provided by further increase safety factors. Although described in conjunction with FIG. 7, the inclined rear panels 180 can be utilized with the other embodiments described herein.

Figure 8:
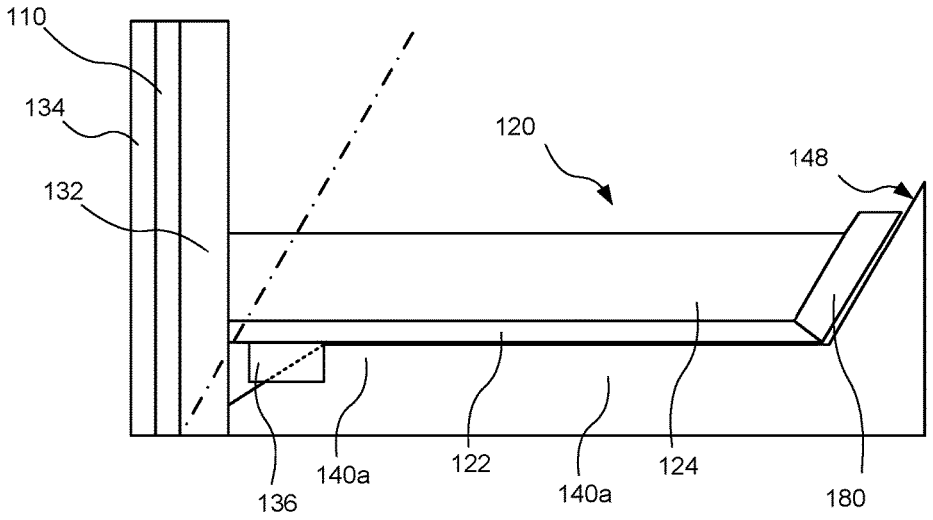
FIG. 8 is a side view of a counterfort beam including an inclined rear panel in accordance with some embodiments of the present invention.
Figure 9:
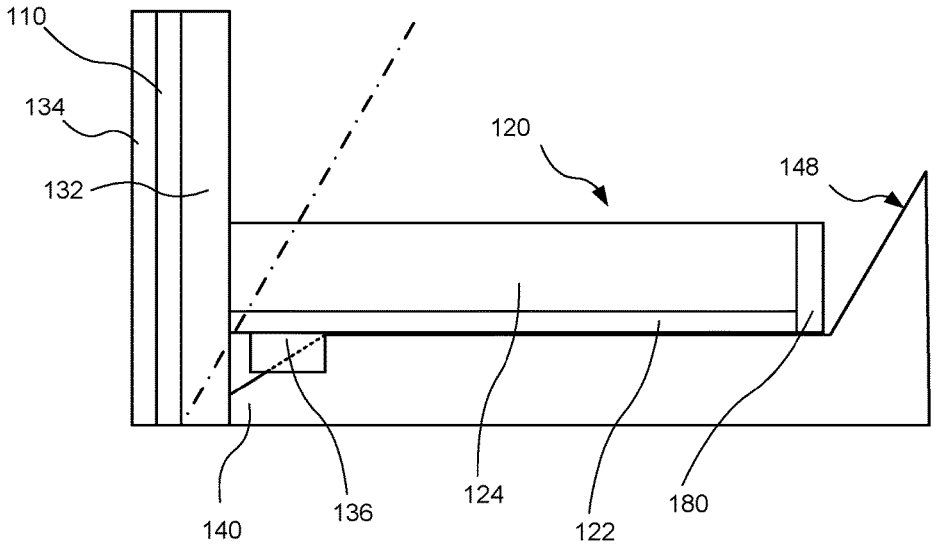
FIG. 9 is a side view of a counterfort beam including a vertical rear panel in accordance with some embodiments of the present invention.

Referring now to FIGS. 8 and 9, the inclined rear panel 180 of FIG. 8 is contrasted with vertical rear panel 180 which is shown in FIG. 9. The sloped excavation cut 148 and the slot cut 141 for both embodiments shown in FIG. 8 and FIG. 9 are approximately the same but the inclined rear panel 180 of FIG. 8 provides resistance from rotational forces as the surface area is increased as well as the moment arm of the force loading down the rear panels from backfill 140 that is placed over the counterfort beams 120.

Since the counterfort beam 120 of FIG. 8 extends to or near to the sloped excavation cut 148 of the existing embankment, the effective base length of the counterfort beam 120 is the overall base length. In other words, the inclined rear panels 180 allow for longer counterfort beams 120 within the same size sloped excavation cut 148.

Conversely, for the vertical rear panel 180 of FIG. 9, the counterfort base length is required to be shorter since there would be interference with the sloped excavation cut 148. For those not skilled in the art it may not be obvious that the rear panels 180 have an effectively longer base length than counterfort base length for the vertical rear panels 180. So, due to the effectively longer base length, critical geotechnical and structural criteria will have higher safety factors with the use of the inclined rear panels 180 compared to those for vertical rear panels 180. Although the vertical rear panels 180 could be used it would typically require that the excavation extend further into the embankment to accommodate the longer equivalent length of the vertical rear panels 180. Therefore, since the use of the vertical rear panels 180 requires more excavation and fill, such an option would typically not be considered due to both the associated reduced safety factors and higher excavation and fill costs.

Figure 10:
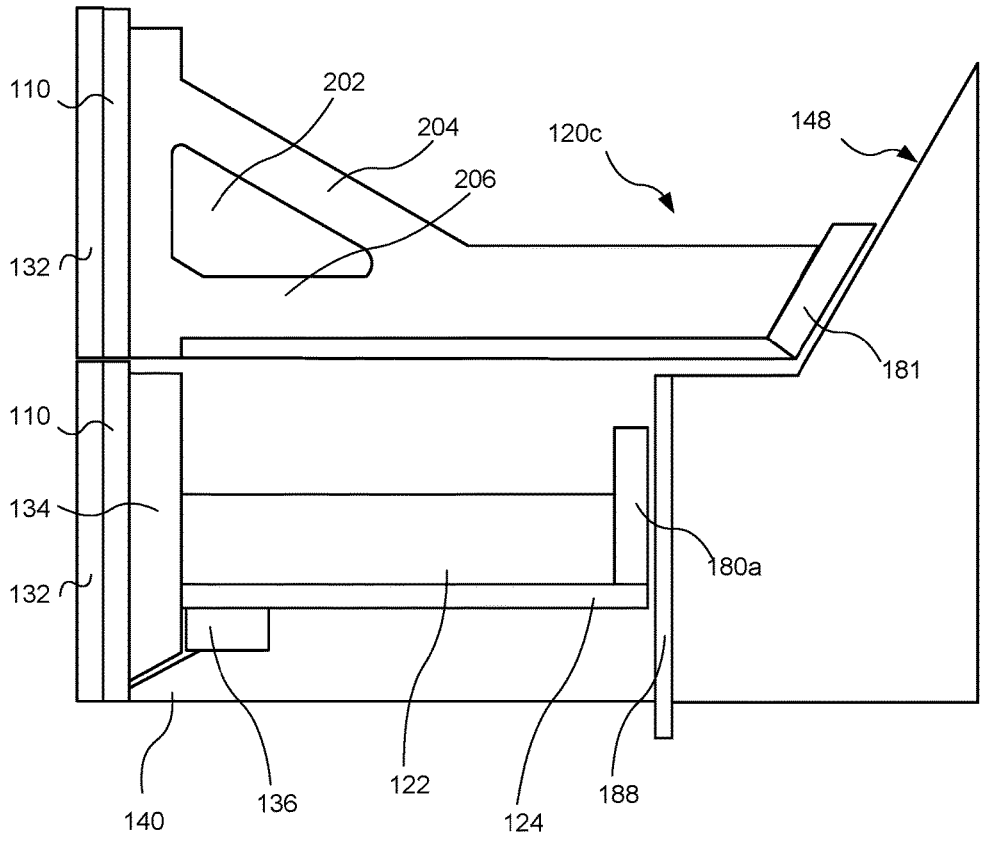
FIG. 10 is a side view illustrating a first and second tier in a counterfort wall system in accordance with some embodiments of the present invention.

Referring to FIG. 10, an alternate vertical section of a two-tier vertical counterfort wall is shown. The lower or base tier utilizes vertical rear panel, due to the limited base length restriction, and because of the required temporary shoring 188 the vertical rear panel option can be a preferred option per specific site conditions. A counterfort beam 120 with an essentially vertically oriented rear panel 180*a* is shown wherein the upper portion of the essentially vertically oriented rear panel 180*a* extends above the counterfort web 122.

A non-elevated base L-shaped counterfort 120*c* is shown utilized for the top tier. The non-elevated base L-shaped counterfort 120*c* includes a variable inclined rear panel 181. The non-elevated base L-shaped counterfort 120*c* is an appropriate optional counterfort profile for wall sites where the allowable soil bearing capacity is adequate for the higher overturning vertical load which is typical for the non-elevated base L-shaped counterfort 120*c*. Since the non-elevated base L-shaped counterfort 120*c* does not require a confined, non-compressible, void replacement member, it will typically be cost effective to use the non-elevated base L-shaped counterfort 120*c* where the site conditions are appropriate.

The non-elevated base L-shaped counterfort 120*c* shown for this example utilizes an optional counterfort web void 202. Due to the counterfort web void 202 a reduction of the counterfort mass and associated reduction in concrete volume and reinforcement is reduced to a minimum. An upper slope arm 204 segment and the lower base segment 206 in conjunction with the counterfort face form a structural truss, which may include equivalent strength characteristics to that of a monolithically cast non-elevated base L-shaped counterfort without a void 202. Where used, the counterfort web void 202 may result in reduced costs for the non-elevated base L-shaped counterfort.

Figure 11:
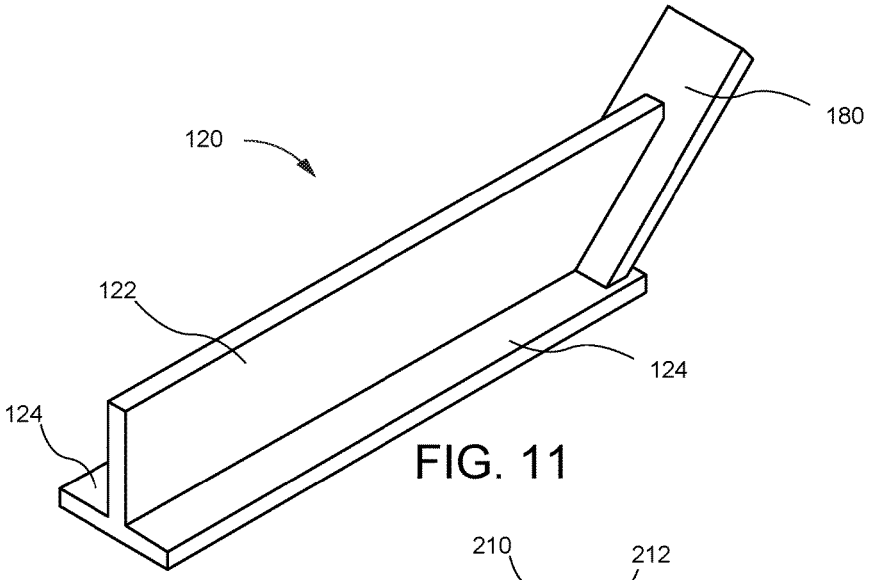
FIG. 11 is a perspective view of a counterfort beam including an inclined rear panel in accordance with some embodiments of the present invention.
Figure 12:
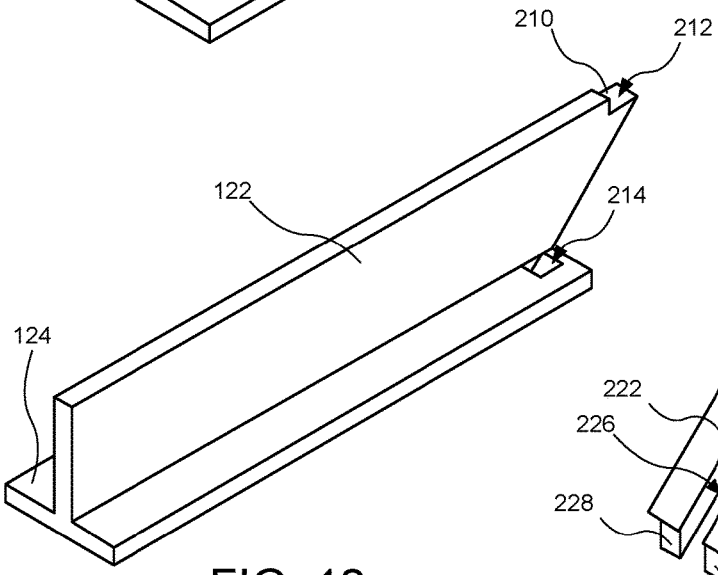
FIG. 12 is a perspective view of the counterfort beam of FIG. 11 with the inclined rear panel removed in accordance with some embodiments of the present invention.

Referring to FIG. 11, a two-piece counterfort beam 120 is shown. The counterfort beam 120 includes a counterfort web 122 and counterfort flange 124 and a detachable inclined rear panel 180. Referring to FIG. 12, the counterfort beam 120 includes a vertical notch 210 with a bearing surface 212 located at an end of the counterfort web 122. The inclined rear panel 180 rests on the bearing surface 212. The counterfort flange 124 includes two void pockets 214 located on an upper surface of the counterfort flange 124 on either side of the counterfort web 122.

Figure 13:
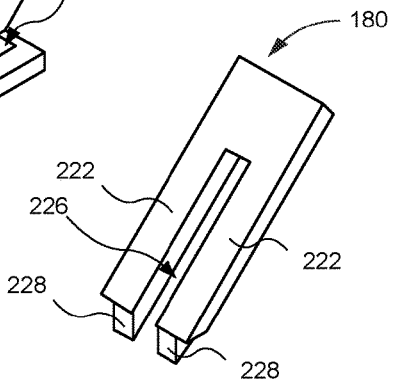
FIG. 13 is a perspective view of the rear panel in accordance with some embodiments of the present invention.

Referring to FIG. 13, the separate inclined rear panel 180 is shown. The inclined rear panel 180 includes two prongs 222 with a slot 226 between the prongs 222. The prongs 222 are configured to straddle each side the counterfort web 122 and the prongs 222 are configured to extend down to the counterfort flange 124. The two prongs include knobs 228 at the base of the prongs 222. The knobs 228 are configured to be inserted into the void pockets 214 in the counterfort flange 124. As shown in FIG. 11, the inclined rear panel 180 couples to the counterfort flange 124 and counterfort web 122 to form a counterfort beam 120 with an inclined rear panel 180. In some embodiments, the inclined rear panel is a separate piece. In some embodiments, the inclined rear panel is integral to the counterfort beam 120. One of skill in the art will recognize other ways to attach the inclined rear panel 180 to the counterfort beam 120.

Figure 14:
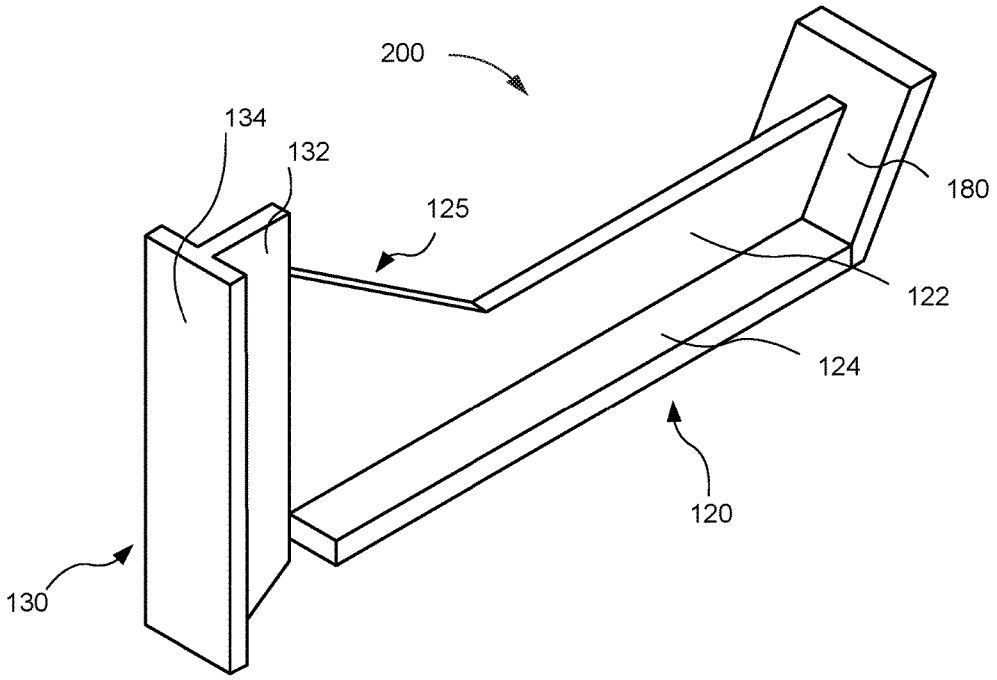
FIG. 14 is a perspective view of a counterfort beam and face joint member in accordance with some embodiments of the present invention.

Referring to FIG. 14, a counterfort assembly 200 is shown with a counterfort beam 120 coupled to a face joint member 130. In the illustrated embodiment, the counterfort web 122 is coupled to the joint web 132 of the face joint member 130. The counterfort web 122 includes an upper extended web 125 at a first end of the counterfort beam 120. The extended web 125 increases the contact area between the counterfort web 122 and the joint web 132 which may provide increased stability. The counterfort beam 120 is a monolithically one-piece cast which eliminates the interfaces and interconnections described in conjunction with FIGS. 11-13.

Figure 15:
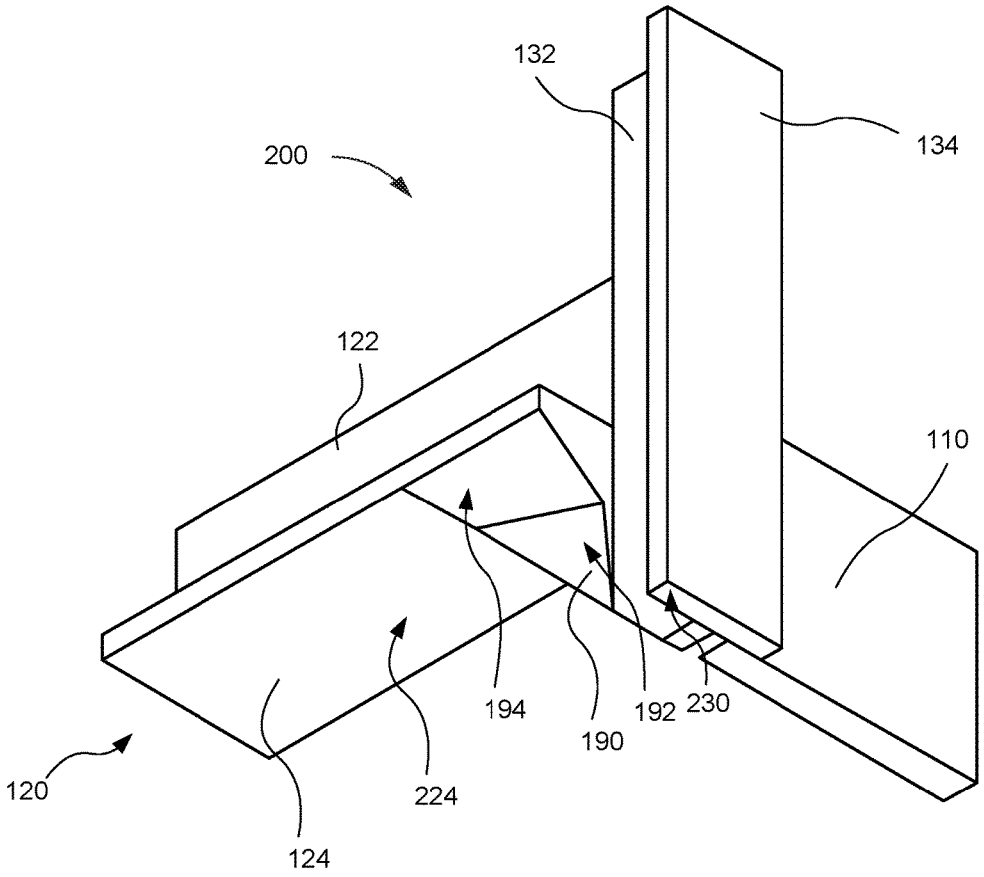
FIG. 15 is a perspective view of a counterfort beam and face joint member in accordance with some embodiments of the present invention.
Figure 16:
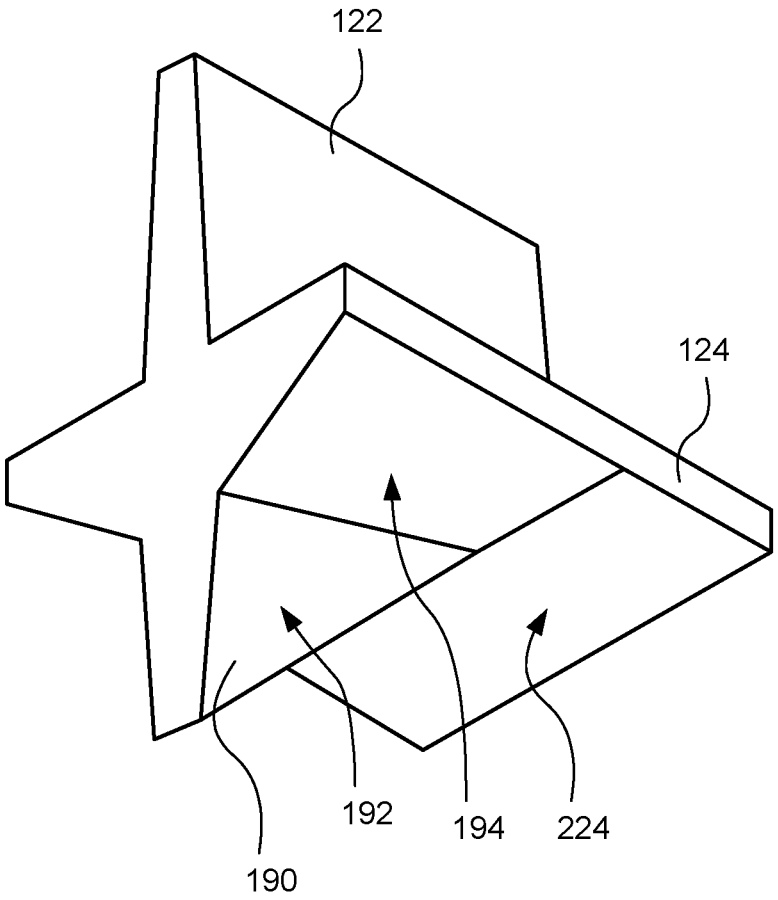
FIG. 16 is a perspective view of a counterfort beam in accordance with some embodiments of the present invention.

Referring to FIG. 15, a counterfort assembly 200 is shown with a counterfort beam 120 coupled to a face joint member 130. FIG. 16 depicts a truncated representation of the counterfort beam 120 of FIG. 15. The counterfort beam 120 includes an extended web 190. The extended web 190 is an extension of the counterfort web 122 in which a portion extends through the counterfort flange 124 and out the bottom of the counterfort beam 120. In the illustrated embodiment, instead of a horizontal bottom surface similar to the bottom surface 224 of the counterfort flange 124, there is a downward sloping face 194 which better allows for the fill material to be placed and compacted after the counterfort beam 120 is coupled to the face joint member 130. Once coupled, it is difficult to see under the counterfort flange 124 but the downward sloping face 194 and vertical sloping face 192 allow for the fill to be compacted underneath the counterfort flange 124.

As is depicted in FIG. 15, the bottom surface 224 of the counterfort flange 124 is elevated above the bottom surface 230 of the face joint member 130. The elevated counterfort beam 120 offers benefits to the assembly that allow for more cost effective walls to be built which can have reduced vertical loads on lower tiers.

Figure 17:
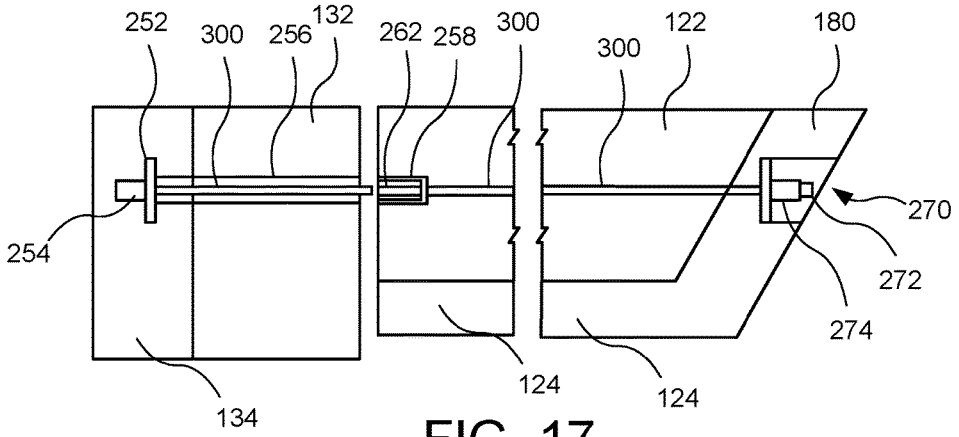
FIG. 17 is a side view of one embodiment of a coupling of a counterfort beam and a face joint member in accordance with some embodiments of the present invention.
Figure 18:
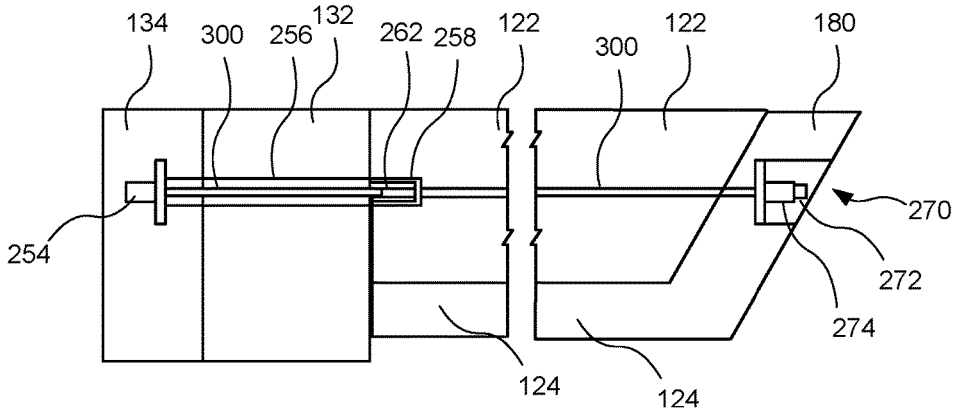
FIG. 18 is a side view of a coupling of a counterfort beam and a face joint member in accordance with some embodiments of the present invention.

Referring to FIGS. 17 and 18, one embodiment of a coupling mechanism is shown. The coupling mechanism, which employs a sleeved threadbar 300, couples the counterfort beam 120 to the face joint member 130. In the illustrated embodiment, the coupling mechanism includes an end plate 252 and a post tension nut 254. In some embodiments, the post tension nut 254 is welded to the end plate 252. The end plate 252 and the post tension nut may be cast into the face joint member 130. A corrugated duct segment 256 may also be cast into the face joint member 130. A sleeved threadbar 300 segment is shown threaded into the post tension nut 254 within the corrugated duct segment 256. The end of the threadbar 300 extends slightly out from the back of the face joint member 130 exposing threads.

The counterfort beam 120 is also shown horizontally displaced from the back of the face joint member 130 by a distance. The counterfort beam 120, in one embodiment, includes a corrugated duct segment 258 cast into the counterfort beam 120 and a sleeved threadbar 300 extending throughout the counterfort beam 120. The sleeved threadbar 300 is coupled to a post tension coupler 274 and a stop bolt 272 at an access opening 270 located in the inclined rear panel 180. In one embodiment, the sleeved threadbar 300 includes an inner metal threaded bar 302 with an outer protective sleeve 306 with a grease layer 304 between the inner metal threaded bar 302 and the outer protective sleeve 306.

Figure 19:
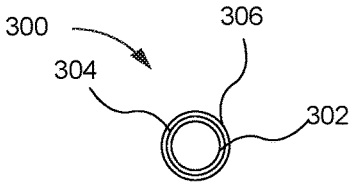
FIG. 19 is a cross sectional view of a threadbar in accordance with some embodiments of the present invention.

A post tension coupler 274 is shown threaded onto the end of the exposed portion of the sleeved threadbar 300 in the access opening 274 at the rear of the inclined rear panel 180. A stop bolt 272 is shown threaded into the post tension coupler 274 to temporarily lock the post tension coupler 274 onto the exposed portion of the sleeved threadbar 300. Referring to FIG. 19, a cross section of the sleeved threadbar 300 is shown. In an embodiment, the sleeved threadbar 300 includes a surrounding polymer sleeve 306 is shown surrounding and encapsulating the protective grease layer 304. A section of the surrounding polymer sleeve 306 has been removed from the end section of the sleeved threadbar bar 300 over the length of the post tension coupler 274 so that the post tension coupler 274 can be threaded onto the exposed steel end (not shown) of the sleeved threadbar 300.

To secure the face joint member 130 to the elevated counterfort beam 120, the stop bolt 272 is rotated which turns the inner metal threaded bar 302. The post tension coupler 274 within the corrugated duct 258 segment rotates as the inner threadbar 302 in the sleeved threadbar 300 rotates. The protective grease layer 162 facilitates the rotation of the inner threadbar 302 within the polymer sleeve 306.

As the post tension coupler 274 is rotated, the exposed end of the inner threaded bar 302 that extends from the back of the counterfort beam 120, will become engaged to the interior (female) threads of the post tension coupler 274 as the face joint member 130 is slowly advanced toward the counterfort beam 120. Since the end plate 252 is welded to the post tension nut 254 that cast in assembly will not rotate as the inner threaded bar 302 is rotated. When the thread engagement distance has been achieved, a post tensioning device may be attached to the post tension coupler 274 in the access opening 270 to apply the required post tensioning force to the sleeved threadbar 300.

After the design post tensioning preload force is applied, which is typically referred to as the lock off load by those skilled in the art, the face joint member 130 and the counterfort beam 120 result in a combined unit that is structurally equivalent to a monolithic counterfort unit following pressure grout injection into the corrugated sleeves 256 and 258 to fully encapsulate the sleeved threadbar 300. Prior to field installation, in one embodiment the access opening 270 will also be filled with dry pack fill grout so that all surfaces of the steel post tensioning components are encapsulated in grout.

For some embodiments, the access opening 270 was on the front face of the wall so that any dry packed grout was visible. In the illustrated embodiment, having a rear post tensioning access opening 270 provides aesthetic options for the wall.

Although described with the above fastening components, the sleeved threadbar 300 may include fewer or more components and/or alternative fastening components to couple the counterfort beam 120 and the face joint member 130.

Figure 24:
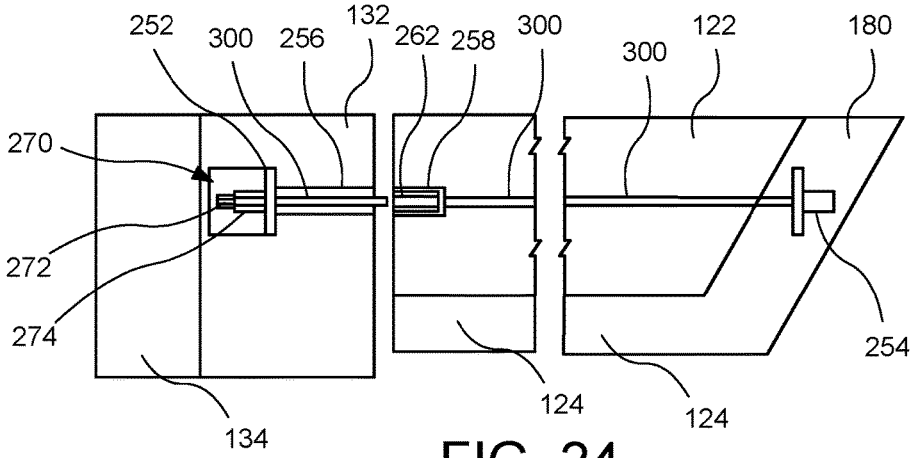
FIG. 24 is a side view of one embodiment of a coupling of a counterfort beam and a face joint member in accordance with some embodiments of the present invention.
Figure 25:
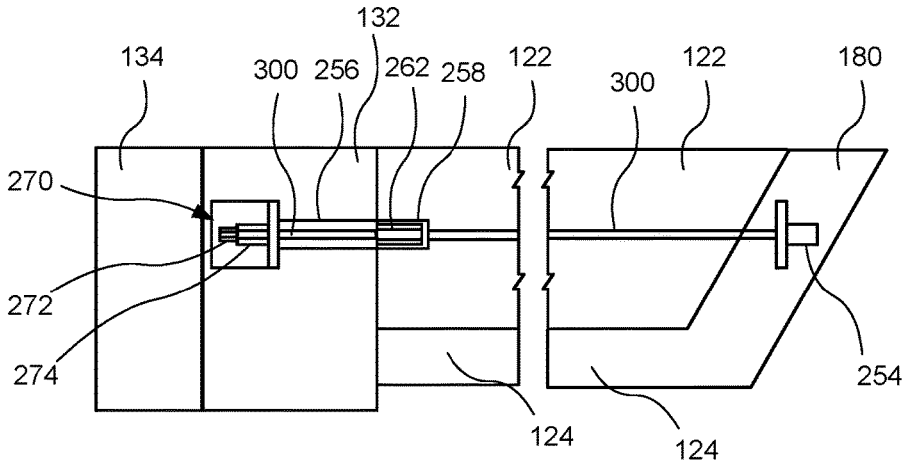
FIG. 25 is a side view of a coupling of a counterfort beam and a face joint member in accordance with some embodiments of the present invention.

Referring now to FIGS. 24 and 25, one embodiment of a coupling mechanism is shown. The coupling mechanism, which employs a sleeved threadbar 300, couples the counterfort beam 120 to the face joint member 130. In the illustrated embodiment, the stop bolt 272 and post tension coupler 274 are positioned in the joint web 132 and are accessed through a post tensioning access opening 270 while a post tension nut 254 is cast into the inclined rear panel 180. As torque tensioning is applied to the stop bolt 272 so that the threadbar 300 is secured in the post tension coupler 274. After torque tensioning, the post tensioning access opening 270 may be dry packed with grout. In other embodiments, the access may be in the joint flange 134.

Figure 20:
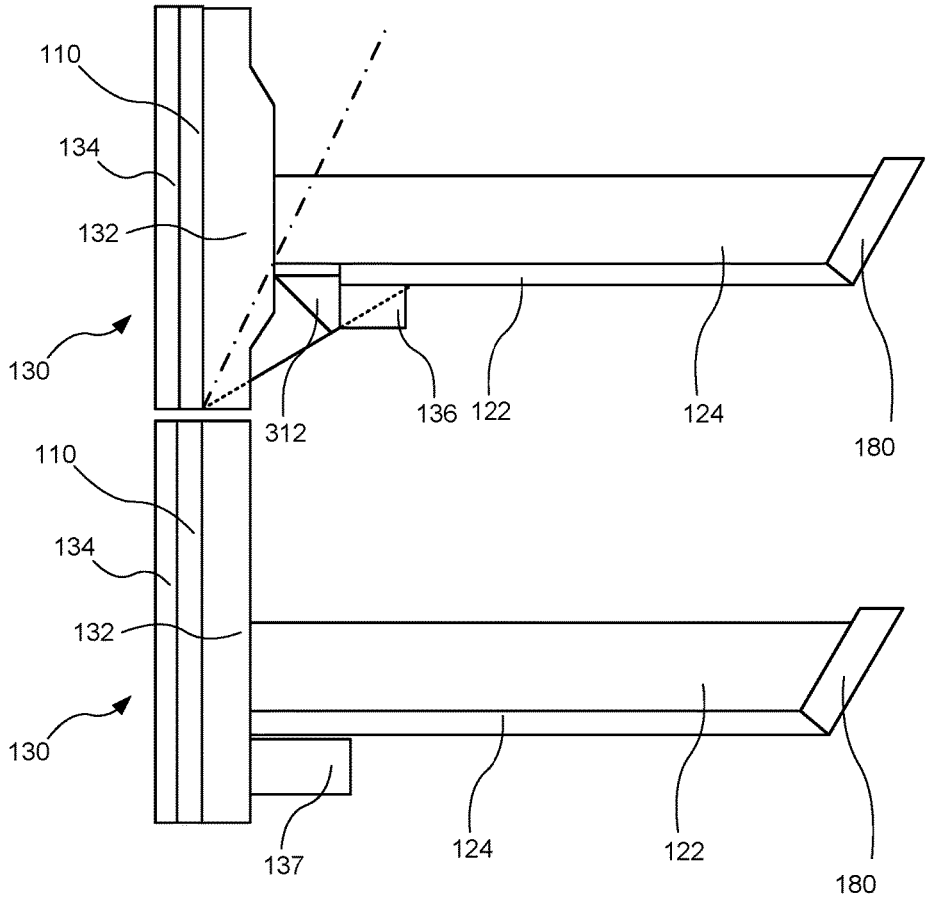
FIG. 20 is a side view illustrating a first and second tier in a counterfort wall system in accordance with some embodiments of the present invention.

Referring to FIG. 20, a side view of a lower tier and upper tier wall is depicted. In the illustrated embodiment, the counterfort members 120 include inclined rear panels 180 and are coupled to the face joint members 130 at a height above the bottom surface of the face joint members 130. Focusing on the upper tier, the counterfort member 120 includes a tapered lower extension 312. Such a tapered lower extension 312 may allow for the placement of the counterfort beam 120 higher on the face joint member 130 than may be possible for other embodiments as the tapered lower extension 312 and the void replacement member 136 work to provide adequate bearing capacity for the front end of the counterfort beam 120. Referring to the lower tier, an extended void replacement member 137 supports the lower counterfort beam 120 under the counterfort flange 124. The extended void replacement member 137 is placed adjacent to the joint web 132 of the face joint member 130.

Figure 21:
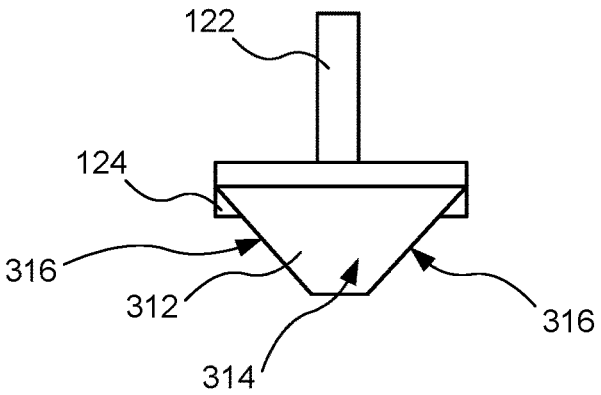
FIG. 21 is a front view illustrating a counterfort beam in accordance with some embodiments of the present invention.
Figure 22:
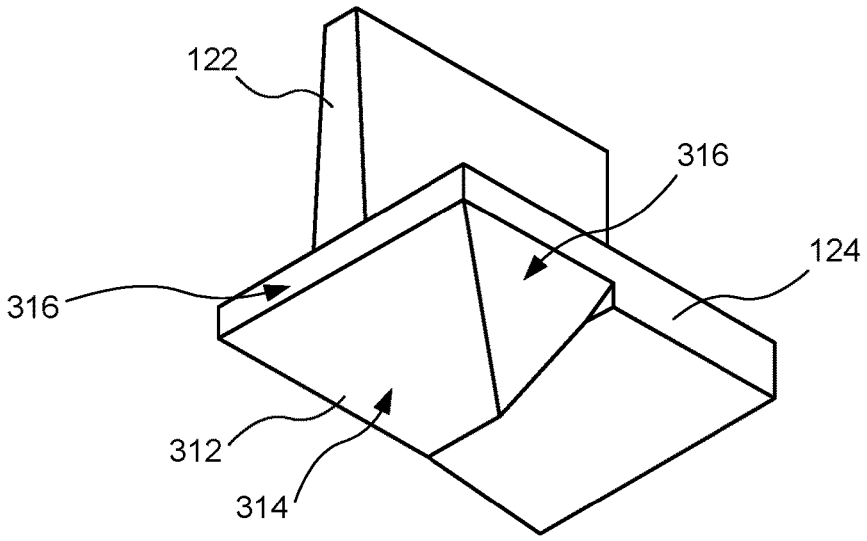
FIG. 22 is a perspective view illustrating a counterfort beam in accordance with some embodiments of the present invention.

Referring to FIGS. 21 and 22, a front view and a lower perspective view of the counterfort beam 120 on the upper tier of FIG. 20 is shown. The counterfort beam 120 includes the tapered lower extension 312. The tapered lower extension 312 includes a front taper 314 that tapers down from the first end 316 of the counterfort flange 124 and side tapers 316 that taper down from the sides of the counterfort flange 124. The tapered lower extension 312 has a small contact area on the sloped backfill but maintains an adequate bearing capacity to support the counterfort beam 120.

Figure 23:
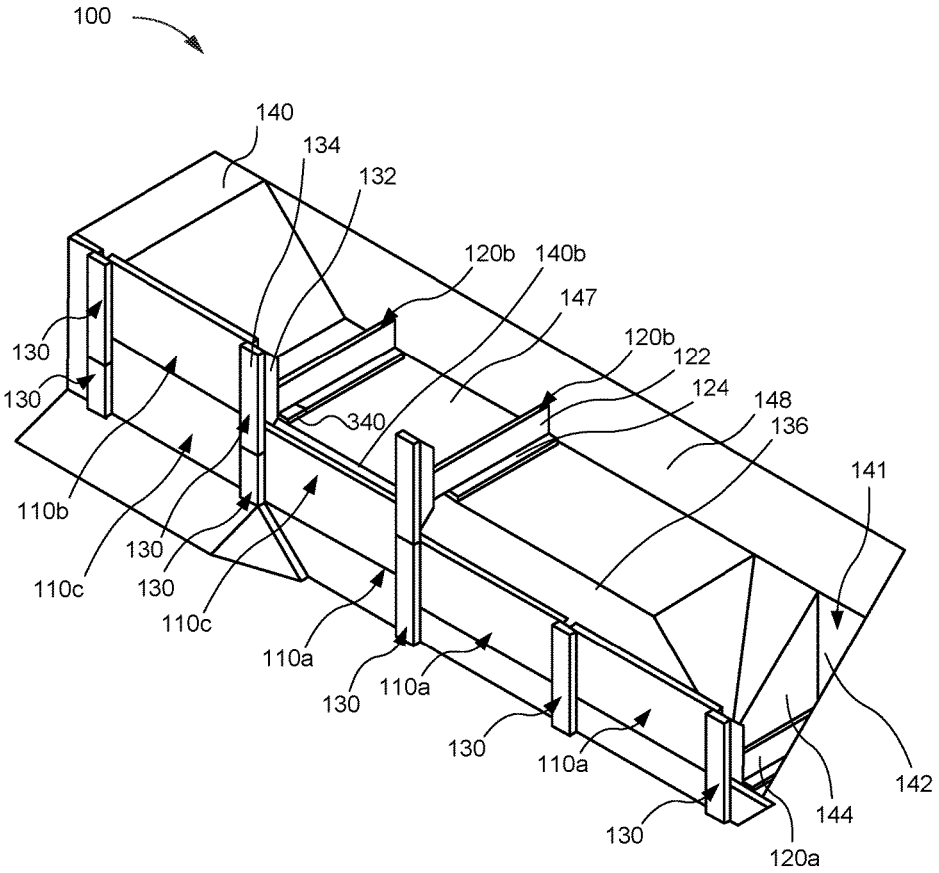
FIG. 23 is a perspective view illustrating another embodiment of a counterfort wall system in accordance with some embodiments of the present invention.

Referring now to FIG. 23, a perspective view illustrating another embodiment of a counterfort wall system 100 is shown. The illustrated embodiment varies from the embodiments described in conjunction with FIGS. 1B and 3. The illustrated embodiment includes wall panels 110*c* which span between the lower tier and upper tier. That is, the top panel edge of the wall panels 110*c* extend above the top edge of the lower face joint member 130 and bottom edge of the upper face joint member 130 (or the horizontal junction between the upper and lower face joint members 130). With the top panel edge of the wall panel 110*c* extended above the horizontal junction, the sloped backfill 140*b* starts at a higher point and thus the horizontal plane 147 extends closer to the face joint member 130 and thus the end of the counterfort beam 120*b*. With the horizontal plane 147 extending closer to the face joint member 130 and thus the end of the counterfort beam 120*b*, the illustrated embodiment does not utilize a void replacement member 136 because no void exists.

In some embodiments, the counterfort flange 124 of the counterfort beam 120*b* does not span an entirety of the length of the counterfort beam 120*b*, but is truncated. In such embodiments, a flange extension 340 is utilized and placed between the counterfort web 122 and the compressed backfill. In some embodiments, dry pack grout is placed between the flange extension 340 and the counterfort web 122.

The illustrated embodiment depicts wall panels 110*c* which span between tiers. Other embodiments may include wall panels 110 which are half panels or less than a full tier.

Embodiments described herein may utilize various size wall panels that are less than, equal, or greater in height than the face joint members 130.

As described herein, the counterfort beam 120 may include various features and components. The components and features described herein relating to a single figure may be included with the components features of the other figures described herein within various combinations.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

In the above description, certain terms may be used such as "up," "down," "upper," "lower," "horizontal," "vertical," "left," "right," "over," "under" and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise. Further, the term "plurality" can be defined as "at least two." Moreover, unless otherwise noted, as defined herein a plurality of particular features does not necessarily mean every particular feature of an entire set or class of the particular features.

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

The present subject matter may be embodied in other specific forms without departing from its spirit or essential characteristics. The described embodiments are to be considered in all respects only as illustrative and not restrictive. All changes which come within the meaning and range of equivalency of the claims are to be embraced within their scope.

What is claimed is:

1. A counterfort retaining wall system, comprising:

a plurality of wall panels in an array and forming a plurality of tiers, wherein the wall panels of a first tier are coplanar to wall panels of a second tier;

a plurality of face joint members positioned between the wall panels, each face joint member partially positioned on a first side of the wall panels and extending between the wall panels through to a second side of the wall panels; and a plurality of counterfort beams, each coupled at a first end to a corresponding face joint member and comprising a counterfort web and a counterfort flange, wherein a counterfort beam of the plurality of counterfort beams extends away from the wall panels and is configured to extend into a backfill behind the plurality of wall panels, wherein the counterfort beam is coupled to the face joint member such that a bottom surface of the counterfort flange is above a bottom edge of the face joint member, wherein the counterfort beam further comprises an inclined rear panel.

2. The system of claim 1, wherein the bottom surface of the counterfort flange is above a location at least one third of a height of the face joint member.

3. The system of claim 1, wherein a first wall panel of the plurality of wall panels spans vertically across a horizontal junction between vertically adjacent face joint members.

4. The system of claim 1, wherein the counterfort beam is coupled to the face joint member such that a bottom surface of the counterfort flange is above a horizontal junction between the tiers.

5. The system of claim 1, wherein the wall panels are rectangular panels comprising a panel face, a rear panel face, a top panel edge, a bottom panel edge, a first side panel edge, and a second side panel edge, and wherein the face joint member comprises a web and flange, wherein the web is positioned between the first side panel edge of the first wall panel and the second side panel edge of the second wall panel.

6. The system of claim 1, wherein the web spans an entirety of a length of the counterfort beam and the flange does not span an entirety of the length of the counterfort beam.

7. The system of claim 1, wherein, at the first end of the counterfort beam, the web extends through the flange.

8. The system of claim 1, wherein the flange and the web span an entirety of a length of the counterfort beam.

9. The system of claim 1, wherein the counterfort beam is coupled to the face joint member such that the flange at the first end of the counterfort beam extends out and above a compressed backfill.

10. The system of claim 1, wherein the inclined rear panel is a separate piece coupled to the web and the flange of the counterfort beam.

11. The system of claim 1, wherein the counterfort beam is coupled to the face joint member by a threadbar that extends through the counterfort beam and into the face joint member, wherein the threadbar comprises an inner metal threaded bar and an outer protective sleeve with a grease layer between the inner metal threaded bar and the outer protective sleeve.

12. The system of claim 11, wherein a first end of the threadbar is formed within the face joint member.

13. The system of claim 1, wherein the counterfort web is orthogonal to the counterfort flange and the wall panel, and the counterfort flange is orthogonal to the wall panel.

14. A counterfort retaining wall system, comprising:

a plurality of wall panels in an array and forming a plurality of tiers, wherein the wall panels of a first tier are coplanar to wall panels of a second tier;

a face joint member positioned between a first wall panel and a second wall panel, the face joint member partially positioned on a first side of the wall panels and extending between the wall panels through to a second side of the wall panels; and a counterfort beam coupled at a first end to the face joint member and comprising a counterfort web and a counterfort flange, wherein the counterfort beam extends away from the wall panels and is configured to extend into a backfill behind the plurality of wall panels, wherein the counterfort beam further comprises an inclined rear panel at a second end of the counterfort beam.

15. The counterfort retaining wall system of claim 14, wherein the counterfort beam is coupled to the face joint member such that a bottom surface of the flange is above a bottom edge of the face joint member.

16. The counterfort retaining wall system of claim 14, wherein the counterfort beam is coupled to the face joint member through a threadbar that extends through the counterfort beam and the face joint member, wherein the threadbar comprises an inner metal threaded bar and an outer protective sleeve with a grease layer between the inner metal threaded bar and the outer protective sleeve.

17. The counterfort retaining wall system of claim 14, wherein the counterfort beam is coupled to the face joint member such that a bottom surface of the counterfort flange is above a horizontal junction between the tiers.

18. The counterfort retaining wall system of claim 14, wherein the inclined rear panel is a separate piece coupled to the web and the flange of the counterfort beam.

19. A counterfort retaining wall system, comprising:

a plurality of wall panels in an array and forming a plurality of tiers, wherein the wall panels of a first tier are coplanar to wall panels of a second tier;

a face joint member positioned between a first wall panel and a second wall panel, the face joint member partially positioned on a first side of the wall panels and extending between the wall panels through to a second side of the wall panels; and a counterfort beam coupled at a first end to the face joint member and comprising a counterfort web and a counterfort flange, wherein the counterfort beam extends away from the wall panels and is configured to extend into a backfill behind the plurality of wall panels, wherein the counterfort beam is coupled to the face joint member such that a bottom surface of the flange is above a bottom edge of the face joint member, and wherein the counterfort beam further comprises an inclined rear panel at a second end of the counterfort beam.

20. The system of claim 1, wherein the inclined rear panel extends above the counterfort web.

21. The system of claim 1, wherein each counterfort beam of the plurality of counterfort beams is formed together with a face joint member of the plurality of face joint members using monolithic construction.

* * * * *